US007362994B2

(12) United States Patent
Zess et al.

(10) Patent No.: US 7,362,994 B2
(45) Date of Patent: Apr. 22, 2008

(54) RELEASE AGENT APPLICATION APPARATUS AND METHOD

(75) Inventors: Martin Franklin Zess, Churchville, NY (US); Mark Steven Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 334 days.

(21) Appl. No.: 11/185,187

(22) Filed: Jul. 20, 2005

(65) Prior Publication Data

US 2007/0020002 A1 Jan. 25, 2007

(51) Int. Cl.
*G03G 15/20* (2006.01)

(52) U.S. Cl. ..... 399/325; 399/326

(58) Field of Classification Search ..... 399/320, 399/324, 325, 326; 118/60
See application file for complete search history.

(56) References Cited

U.S. PATENT DOCUMENTS 4,083,322 A 4/1978 Beckman, Jr.
4,214,549 A 7/1980 Moser
4,231,653 A 11/1980 Nagahara et al.
4,743,943 A 5/1988 Adams, Jr. et al.
4,766,456 A 8/1988 Pirwitz
4,924,271 A 5/1990 Brinton et al.
5,061,965 A * 10/1991 Ferguson et al. ..... 399/325
5,145,525 A 9/1992 Fromm et al.
5,327,204 A 7/1994 Sculley et al.
5,353,107 A 10/1994 Sculley et al.
5,520,732 A 5/1996 Sarfati
5,634,184 A 5/1997 Dalal et al.
5,974,293 A * 10/1999 Fromm ..... 399/325
5,991,562 A * 11/1999 Ito et al. ..... 399/67
6,591,081 B2 * 7/2003 Hasegawa ..... 399/324

* cited by examiner

*Primary Examiner*—Hoan H. Tran
(74) *Attorney, Agent, or Firm*—Maginot, Moore & Beck LLP

(57) ABSTRACT

A release agent application apparatus includes a liquid-permeable member, a first release agent metering member abutting the liquid-permeable member, and a pump operatively connected to the liquid-permeable member to pump the release agent therethrough.

14 Claims, 2 Drawing Sheets

RELEASE AGENT APPLICATION APPARATUS AND METHOD

TECHNICAL FIELD

The presently disclosed embodiments relate to applying release agents to fusers to facilitate heat and pressure fixing of marking particles in imaging devices such as, for example, xerographic printing devices.

BACKGROUND

The basic principles of electrostatographic printing with dry marking material (hereinafter generally referred to as "xerography," "xerographic printing," and/or the like) are well known: a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure. To affix or fuse electroscopic toner material onto a support member by heat and pressure, the temperature of the toner material is typically elevated to a point at which its constituents coalesce and become tacky while and pressure is simultaneously applied, thus causing the toner to flow to some extent into the fibers or pores of the support member or otherwise upon the surface thereof. Thereafter, as the toner material cools, solidification of the toner material occurs and the toner material becomes bonded firmly to the support member.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby heating the toner images within the nip. By controlling the heat transferred to the toner, virtually no transfer or "offsetting" of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a "splitting" action in the molten toner resulting in "hot offset." Splitting occurs when the cohesive forces holding the viscous toner mass together become less than the adhesive forces tending to offset it to a contacting surface such as a fuser roll. Occasionally, however, toner particles may be offset to the fuser roll by an insufficient application of heat to the surface thereof (i.e. "cold" offsetting), by imperfections in the properties of the surface of the roll, or by the toner particles insufficiently adhering to the copy sheet by the electrostatic forces which normally hold them there. In such cases, toner particles may be transferred to the surface of the fuser roll with subsequent transfer to the backup roll during periods of time when no copy paper is in the nip. Moreover, toner particles can be picked up by the fuser and/or backup roll during fusing of duplex copies or simply from the surroundings of the reproducing apparatus.

One arrangement for minimizing some of the problems associated with heat and pressure fusing, particularly offsetting, has been to provide the fuser roll with an outer surface or covering of polytetrafluoroethylene, widely distributed under the trademark TEFLON®, to which a release agent such as silicone oil is applied, the thickness of the TEFLON® material being on the order of several mils and the thickness of the oil being less than 1 micron. Alternatively, a layer of silicone rubber or Viton has been be used. The silicone rubber layer may provide conformability with the paper roughness resulting in more uniform fixing and image gloss. Silicone based (polydimethylsiloxane) oils possessing a relatively low surface energy have been found to be suitable for use in the heated fuser roll environment where TEFLON® material constitutes the outer surface of the fuser roll. In practice, a thin layer of silicone oil has been applied to the surface of the heated roll to form an interface between the roll surface and the toner images carried on the support material, thus presenting a low surface energy layer to the toner as it passes through the fuser nip and thereby preventing toner from offsetting to the fuser roll surface. A fuser roll construction of the type described above is fabricated by applying in any suitable manner a solid layer of adhesive material to a rigid core or substrate such as the solid TEFLON® outer surface or covering of the aforementioned arrangement.

Donor roll release agent management ("RAM") systems have been used as parts of roll fuser apparatuses for some time. Such a RAM system is disclosed in U.S. Pat. No. 4,214,549 to Moser, issued Jul. 29, 1980 ("Moser"). Moser illustrates a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The heated fuser roll is characterized by an outer layer or surface that, by way of example, is fabricated from a silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll. The release fluid oil is picked up onto the metering roll as it is rotated through the release fluid oil, which is then metered to a very thin film on the metering roll by a metering blade. In many similar apparatuses, oil is pumped into a trough or collected in a sump wherein it saturates and covers a swiper wick. The metering roll is then loaded to interfere with the swiper wick. Among other things, the wick prevents air entrapment between the moving metering roll and the stationary oil.

Ensuring consistent applications of clean oil to metering rolls via capillary draws through swiper wicks has been challenging.

SUMMARY

According to aspects illustrated herein, there is provided a release agent application apparatus including a liquid-permeable member, a first release agent metering member abutting the liquid-permeable member, and a pump operatively connected to the liquid-permeable member to pump the release agent therethrough. The apparatus could be used in a number of devices such as, for example, a xerographic printing device.

According to aspects illustrated herein, there is provided a release agent application apparatus including a means for metering the release agent, a liquid-permeable means, abutting the metering means, for swiping the release agent onto the metering means, and a means, operatively connected to the swiping means, for pumping the release agent through the swiping means. The apparatus could be used in a number of devices such as, for example, a xerographic printing device.

According to aspects illustrated herein, there is provided a release agent application method including pumping the release agent to a metering roll and metering the release agent on the metering roll.

DETAILED DESCRIPTION

Figure 1:
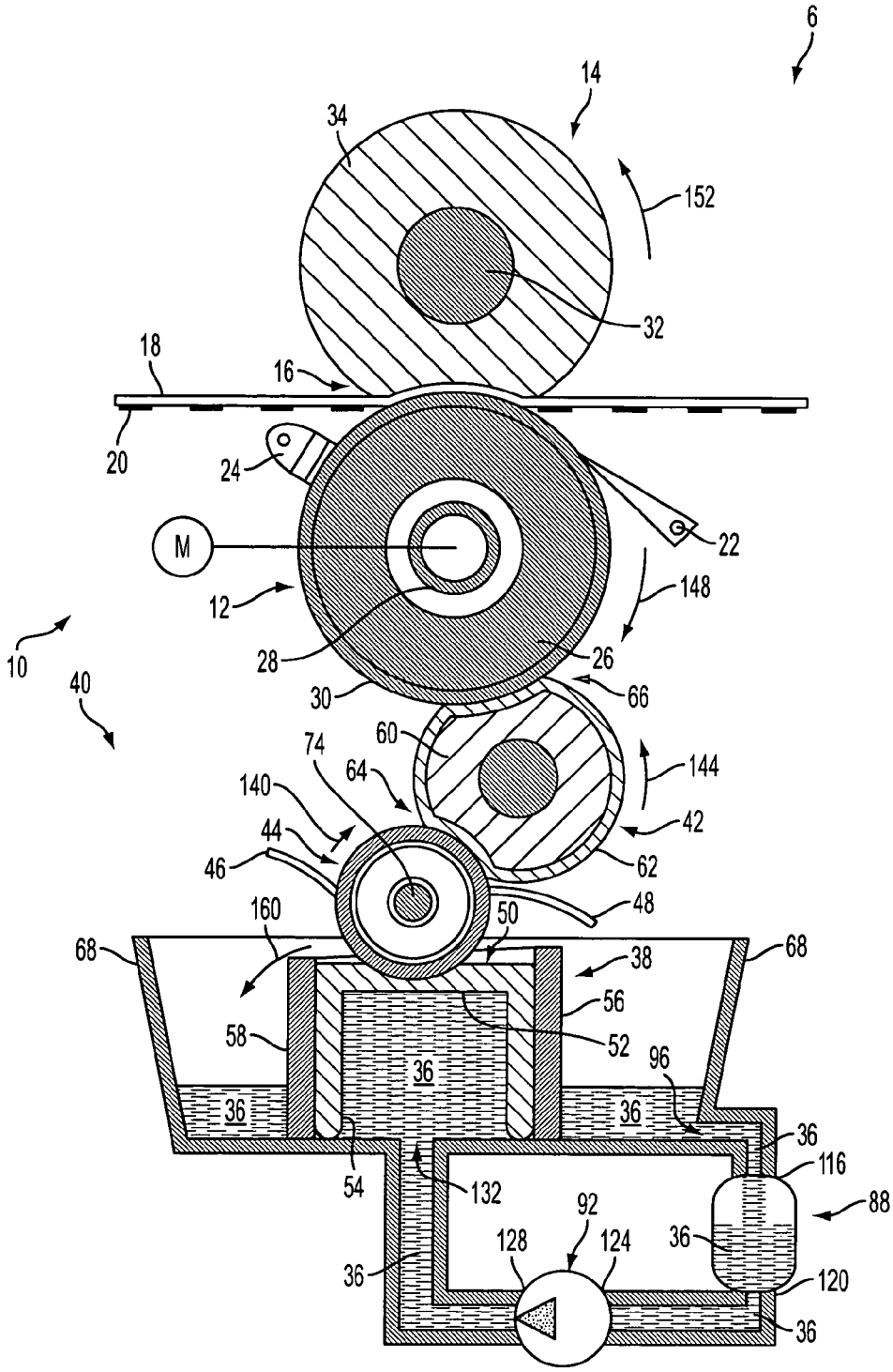
FIG. 1 shows a simplified cross-sectional schematic view of an exemplary toner image heat and pressure fusing system.

FIG. 1 shows a simplified cross-sectional schematic view of an exemplary toner image heat and pressure fusing system 6. System 6 includes a fuser roll subsystem 10. Subsystem 10 includes a heated roll structure 12 and a non-heated backup roll structure 14. Roll structure 12 cooperates with backup roll structure 14 to form a nip 16 through which a copy substrate 18 passes with toner images 20 formed thereon in a known manner. Toner images 20 contact roll structure 12 while a force is applied between roll structure 12 and backup roll structure 14 in a known manner to create pressure therebetween, resulting in deformation of backup roll structure 14 by roll structure 12 to thereby form nip 16. As substrate 18 passes out of nip 16, it is stripped from roll structure 12 by a plurality (only one shown) of stripping devices 22, after which it is free to move along a predetermined path toward an exit of the machine (not shown) in which system 6 is installed. Meanwhile, subsystem 10 also includes a contact temperature sensor 24 that senses the surface temperature of roll structure 12 and, in conjunction with conventional circuitry (not shown), maintains the surface temperature to a predetermined value, for example, on the order of 375-400 degrees Fahrenheit.

Roll structure 12 includes a hollow cylinder 26 having a radiant quartz heater 28 disposed in the hollow thereof. When suitably energized via the aforementioned circuitry, the heating element radiates heat that is conducted to the outer surface of an outer layer 30 of roll structure 12, which is made from Viton. Alternatively, outer layer 30 may be made from silicone rubber, TEFLON®, or any other suitable material.

Backup roll structure 14 includes a solid metal core 32 to which is adhered a relatively thick layer 34 of deformable material such as, for example, an elastomer known as ethylene-propylene terpolymer, which is based on stereospecific linear terpolymers of ethylene, propylene and small amounts of non-conjugated diene which is commonly referred to as EPDM and carries a thin overcoat of PFA or a thick layer of silicone rubber. Due to the construction of backup roll structure 14 it is deformed by the harder roll structure 12 when the required pressure is applied therebetween, the pressure being a function of the desired deformation which corresponds to the desired length of nip 16 as known.

As discussed further below, outer layer 30 is coated with a liquid release agent 36 that circulates through, among other things, a trough-like receptacle 38. Release agent 36 may be made from a polymeric release agent having functional groups such as carboxy, hydroxy, epoxy, ammo, isogenate, thioether or mercepto groups. In the case of a TEFLON® or silicone rubber outer layer 30 the functional group may be omitted. The oil viscosity of release agent 36 is in the order of 100-250 cs.

For coating outer layer 30 of roll structure 12, system 6 includes a release agent management ("RAM") subsystem 40. RAM subsystem 40 includes receptacle 38, a donor roll 42, a metering roll 44, a metering blade or "doctor blade" 46, a cleaning blade 48, and a liquid-permeable release agent applicator 50.

Applicator 50 is configured to, among other things, apply amounts of release agent 36 to metering roll 44 and is fabricated from medium density, non-woven (non-weaved) "Nomex" fibers typical of Nomex fibers conventionally used in heat and pressure fusers for wicking oil to the fuser rolls or, alternatively, applicator 50 may be made from any other suitably material. Applicator 50 includes a generally rectilinear, generally plank-shaped head portion 52 that caps receptacle 38 further includes and a generally rectilinear sidewall 54 extending generally perpendicularly from head portion 52 into deeper immersion in release agent 36. As discussed further below, sidewall 54 facilitates backup wicking, among other things. It is noted that sidewall 54 may be omitted when backup wicking is not desired.

Receptacle 38 is positioned in a sump 68. Receptacle 38 is configured to, among other things, retain applicator 50, receive a volume of release agent 36, transfer amounts of release agent 36 to applicator 50, and direct residual amounts of release agent 36 into sump 68. Receptacle 38 includes an end-wall 56 and a relatively shorter opposing end-wall 58. As discussed further below, end-wall 58 may alternatively be the same height as end-wall 56.

Figure 2:
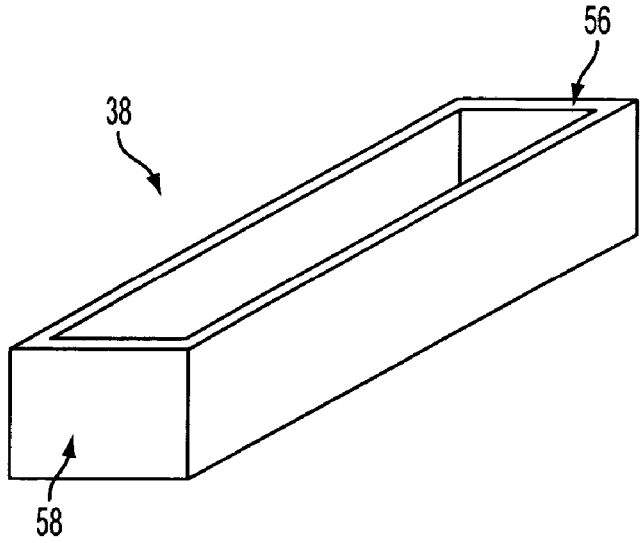
FIG. 2 shows an isolated perspective view of the exemplary receptacle of the exemplary toner image heat and pressure fusing system of FIG. 1.

FIG. 2 shows an isolated perspective view of receptacle 38. End-wall 56 and end-wall 58 are also discernable in FIG. 2.

Returning to FIG. 1, metering roll 44 is rotatably supported in contact with an exterior surface of head portion 52 of applicator 50. Metering roll 44 is supported for rotation, such rotation being derived by means of the positively driven roll structure 12 via rotatably supported donor roll 42. Through head portion 52, applicator 50 applies release agent 36 to metering roll 44 as discussed further below.

Donor roll 42 includes a deformable base layer 60 and an outer layer 62 which form a first nip 64 between metering roll 44 and donor roll 42 and a second nip 66 between donor roll 42 and roll structure 12. Nip 64 and nip 66 also permit satisfactory transfer of release agent 36 between metering roll 44 and donor roll 42, and in turn between donor roll 42 and roll structure 12, respectively.

Metering blade 46 is configured as known to squeegee or otherwise remove undesired amounts of release agent 36 from metering roll 44 and thus meter the amount of release agent 36 transferred to donor roll 42. Metering blade 46 is positioned such that the amounts of release agent 36 that are metered off metering roll 44 fall into receptacle 38 proximal to end-wall 58.

Cleaning blade 48 is configured as known to scrape or otherwise remove stray toner particles and/or other debris from metering roll 44 and thus clean metering roll 44. Cleaning blade 48 is positioned such that the debris that is cleaned off metering roll 44 substantially falls into sump 68 rather than into receptacle 38.

Figure 3:
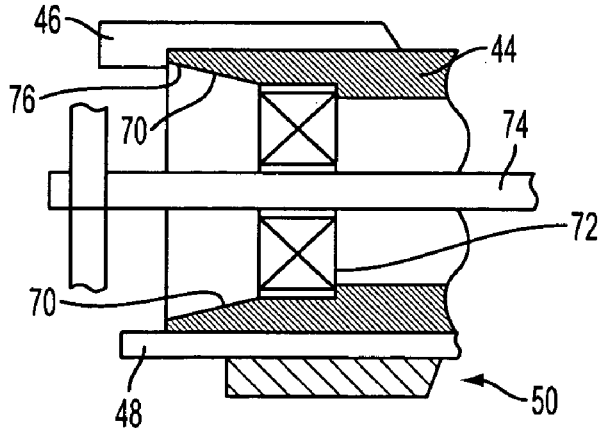
FIG. 3 is an enlarged fragmentary view of ends of the exemplary applicator, the exemplary metering roll, the exemplary metering blade, and the exemplary cleaning blade of the exemplary toner image heat and pressure fusing system of FIG. 1.

FIG. 3 is an enlarged fragmentary view of ends of applicator 50, metering roll 44, metering blade 46, and cleaning blade 48. As at least partially discernable in FIG. 3, metering blade 46 is as long as or longer than metering roll 44 and applicator 50. Metering roll 44 is also longer than donor roll 42. Further, metering roll 44 is rotatably supported by bearings 72 (only one shown) which, in turn, are supported by a fixed shaft 74. Metering roll 44 is also rounded at its ends as indicated by reference character 76, thus providing smooth areas of contact between the conformable metering blade 46 and metering roll 44 and between the conformable cleaning blade 48 and metering roll 44, respectively, so as to hinder degradation of metering blade 46 and cleaning blade 48 by metering roll 44.

Returning to FIG. 1, subsystem 40 also includes sump 68, a drain bottle 88, and a feed pump 92. A drain 96 of sump 68 is hydraulically coupled to an inlet 116 of drain bottle 88. An outlet 120 of drain bottle 88 is hydraulically coupled to an inlet 124 of feed pump 92. An outlet 128 of feed pump 92 is hydraulically coupled to an inlet 132 of receptacle 38.

In operation, metering roll 44 rotates as indicated by directional arrow 140. Further, donor roll 42 rotates as indicated by directional arrow 144. Also, roll structure 12 rotates as indicated by directional arrow 148, and backup roll 14 rotates as indicated by directional arrow 152.

Feed pump 92 fills receptacle 38 with release agent 36 and pumps suitable amounts of release agent 36 through head portion 52 of applicator 50 (which filters suitable amounts of any debris from release agent 36) to metering roll 44. As metering roll 44 rotates, head portion 52 of applicator 50 swipes suitable amounts of release agent 36 onto metering roll 44.

Metering blade 46 removes undesired amounts of release agent 36 from metering roll 44. The amounts of release agent 36 that metering blade 46 meters off metering roll 44 fall into receptacle 38 proximal to end-wall 58. These metered off amounts of release agent 36 (along with the bulk of any excess release agent 36 that passes through applicator 50 but is not effectively transferred to metering roll 44) fall over end-wall 58 into sump 68 as indicated generally by directional arrow 160. While the relatively shorter height of end-wall 58 as compared to end-wall 56 facilitates the flow of release agent 36 over end-wall 58, it is noted that the rotation of metering roll 44 encourages the flow over end-wall 58 as well and, thus, end-wall 58 may alternatively be the same height as end-wall 56.

Metering roll 44 transfers suitable amounts of release agent 36 to donor roll 42 at nip 64.

Cleaning blade 48 removes suitable amounts of any debris from metering roll 44. This removed debris substantially bypasses receptacle 38 and substantially falls into sump 68, where it mixes with the amounts of release agent 36 that have fallen over end-wall 58.

Gravity delivers suitable amounts of release agent 36 from sump 68 to drain bottle 88.

Usually, feed pump 92 draws release agent 36 from drain bottle 88, and feed pump 92 pumps release agent 36 as discussed above. However, in the event that feed pump 92 fails, applicator 50 provides "backup wicking" of release agent 36 by wicking amounts of release agent 36 from receptacle 38 (via sidewall 54) to head portion 52, where these amounts of release agent 36 are in turn presented to metering roll 44.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The words "printer," "printing device," and the like as used herein encompass any apparatus, such as a digital copier, bookmaking machine, facsimile machine, multifunction machine, etc. which forms a print outputting function for any purpose.

What is claimed is:

1. A release agent application apparatus, comprising:
a liquid-permeable member;
a first release agent metering member abutting the liquid-permeable member;
a pump operatively connected to the liquid-permeable member to pump the release agent therethrough; and
a receptacle operatively connected to the pump to receive the release agent therefrom, the receptacle being capped by the liquid permeable member such that the liquid permeable member is positioned substantially within an opening of the receptacle.

2. The apparatus of claim 1, the first release agent metering member including a metering roll.

3. The apparatus of claim 2, the liquid-permeable member including a head portion for capping the receptacle and at least one sidewall extending from the head portion into an interior of the receptacle, the at least one sidewall being configured to wick the release agent in the interior of the receptacle to the head portion of the liquid-permeable member.

4. The apparatus of claim 1, the liquid-permeable member including a head portion for capping the receptacle and at least one sidewall extending from the head portion into an interior of the receptacle, the at least one sidewall being configured to wick the release agent in the interior of the receptacle to the head portion of the liquid-permeable member.

5. A release agent application apparatus, comprising:
a liquid-permeable member;
a first release agent metering member abutting the liquid-permeable member;
a pump operatively connected to the liquid-permeable member to pump the release agent therethrough;
a receptacle capped by the liquid-permeable member and operatively connected to the pump to receive the release agent therefrom; and
a sump;
wherein the receptacle is positioned in the sump.

6. A release agent application apparatus, comprising:
a liquid-permeable member;
a first release agent metering member abutting the liquid-permeable member;
a pump operatively connected to the liquid-permeable member to pump the release agent therethrough;
a cleaning member abutting the first release agent metering member; and
a second release agent metering member abutting the first release agent metering member;
wherein the first release agent metering member includes a metering surface, the first release agent metering member is configured to move the metering surface in a first direction, and the liquid-permeable member is positioned between the cleaning member and the second release agent metering member relative to the first direction.

7. The apparatus of claim 6, wherein the first release agent metering member includes a metering roll.

8. The apparatus of claim 7, wherein the cleaning member includes a cleaning blade.

9. The apparatus of claim 8, wherein the second release agent metering member includes a metering blade.

10. The apparatus of claim 8, further comprising:

a sump; and a receptacle positioned in the sump, capped by the liquid-permeable member, and operatively connected to the pump to receive the release agent therefrom;

wherein the cleaning blade is positioned to direct debris past the receptacle and sump.

11. A release agent application method, comprising:

pumping the release agent into a receptacle, through a liquid permeable applicator positioned in an opening of the receptacle, and onto a metering roll; and metering the release agent on the metering roll.

12. The method claim 11, further comprising swiping the release agent onto the metering roll with the liquid permeable member.

13. The method of claim 11, further comprising wicking the release agent on the metering roll via the liquid-permeable applicator, the liquid-permeable member including a head portion for abutting the metering roll and at least one sidewall extending from the head portion into an interior of the receptacle, the at least one sidewall being configured to wick the release agent in the interior of the receptacle to the head portion of the liquid-permeable member.

14. A release agent application method, comprising:

pumping the release agent to a metering roll;

metering the release agent on the metering roll;

swiping the release agent onto the metering roll; and cleaning the metering roll;

wherein the swiping is done between the cleaning and the metering.

* * * * *